US009155953B2

(12) United States Patent
Zhao et al.

(10) Patent No.: US 9,155,953 B2
(45) Date of Patent: Oct. 13, 2015

(54) PHOTOELECTRIC SENSING INSTANT DISPLAY TYPE GOLF SWING COLLIMATION TRAINER

(76) Inventors: Yansheng Zhao, Jiangsu (CN); Xufeng Wu, Jiangsu (CN)

( * ) Notice: Subject to any disclaimer, the term of this patent is extended or adjusted under 35 U.S.C. 154(b) by 652 days.

(21) Appl. No.: 13/516,220

(22) PCT Filed: Sep. 30, 2011

(86) PCT No.: PCT/CN2011/080508

§ 371 (c)(1), (2), (4) Date: Jun. 14, 2012

(87) PCT Pub. No.: WO2012/083744

PCT Pub. Date: Jun. 28, 2012

(65) Prior Publication Data

US 2012/0309555 A1 Dec. 6, 2012

(30) Foreign Application Priority Data

Dec. 22, 2010 (CN) ..... 2010 2 0674584 U

(51) Int. Cl.
*A63B 69/36* (2006.01)

(52) U.S. Cl.
CPC ..... *A63B 69/3623* (2013.01); *A63B 69/3676* (2013.01); *A63B 69/3641* (2013.01); *A63B 2220/805* (2013.01)

(58) Field of Classification Search
CPC ..... A63B 69/3623; A63B 69/3676; A63B 69/3641; A63B 69/3614; A63B 2220/805
USPC ..... 473/220, 221, 222
See application file for complete search history.

(56) References Cited

U.S. PATENT DOCUMENTS

| | | | | |
|---|---|---|---|---|
| 2,571,974 | A * | 10/1951 | John Walker | 473/225 |
| 3,801,108 | A * | 4/1974 | Murray | 473/225 |
| 5,634,855 | A * | 6/1997 | King | 473/221 |
| 5,718,639 | A * | 2/1998 | Bouton | 473/151 |
| 6,227,984 | B1 * | 5/2001 | Blankenship | 473/221 |
| 8,177,654 | B2 * | 5/2012 | Pelz | 473/220 |
| 2003/0054898 | A1 * | 3/2003 | Otten et al. | 473/219 |
| 2006/0014589 | A1 * | 1/2006 | Kim | 473/233 |
| 2006/0030432 | A1 * | 2/2006 | Katayama | 473/407 |
| 2007/0105637 | A1 * | 5/2007 | Shimizu | 473/151 |
| 2010/0304876 | A1 * | 12/2010 | Hohla et al. | 473/199 |
| 2011/0151985 | A1 * | 6/2011 | Loh | 473/222 |
| 2012/0108353 | A1 * | 5/2012 | Kamino et al. | 473/219 |

* cited by examiner

*Primary Examiner* — Jay Liddle
(74) *Attorney, Agent, or Firm* — Global IP Services; Tianhua Gu

(57) ABSTRACT

A photoelectric sensing instant display type golf swing collimation trainer comprises a base (1) and a display device (2), two photoelectric sensor mounting supports (3, 3') are mounted on the base (1), two groups of photoelectric detection devices with transmitters (4) and sensors (5) are mounted on each mounting support (3 or 3'), the distance between the two sensors (5) on each mounting support is matched with the distance of the straight line section at the bottom of a club head of a golf club, when the club head of the golf club passes between the transmitters (4) and the sensors (5), the pulse receiving of the sensors (5) is blocked, and the sensors (5) are used for sending the synchronous state of blocking the pulse receiving of the club head of the golf club to the display device (2) which is electrically connected with the sensors (5) for real-time display.

4 Claims, 1 Drawing Sheet

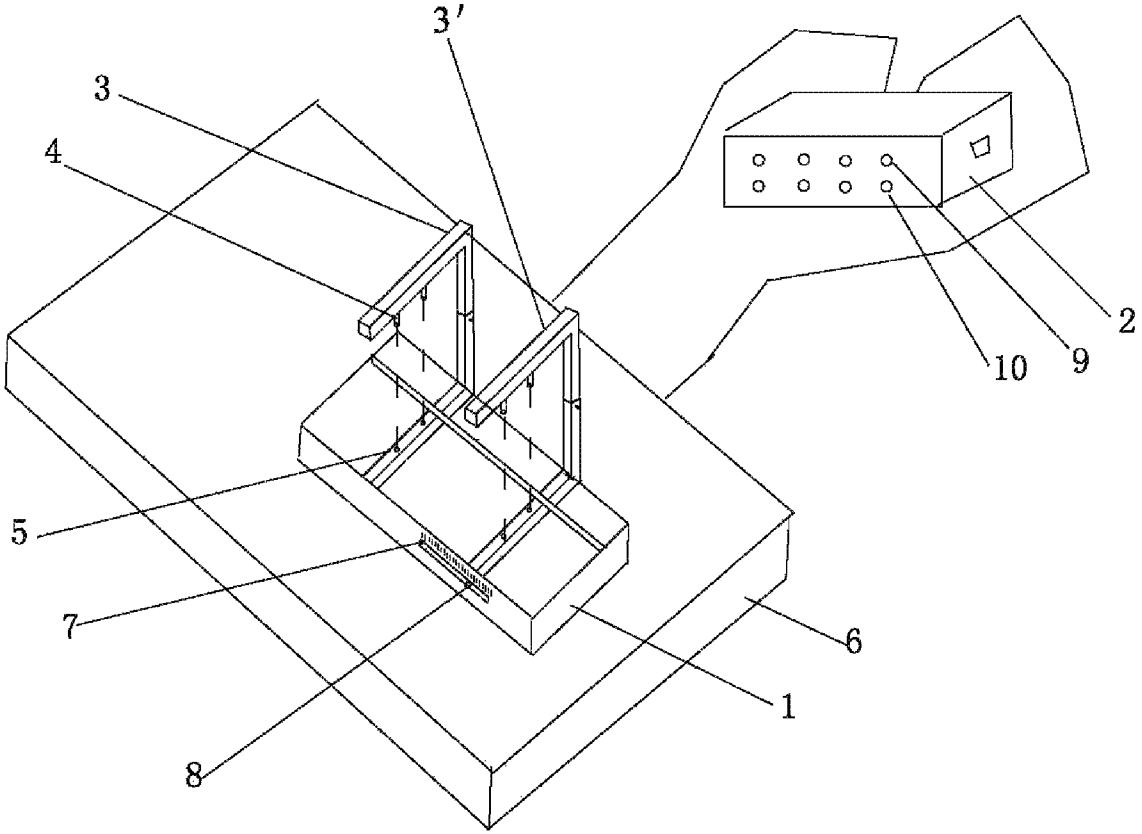
3'
3
4
5
7
8
1
6
2
9
10

PHOTOELECTRIC SENSING INSTANT DISPLAY TYPE GOLF SWING COLLIMATION TRAINER

CROSS REFERENCE TO RELATED PATENT APPLICATION

The present application is the US national stage of PCT/CN2011/080508 filed on Sep. 30, 2011, which claims the priority of the Chinese patent application No. 201020674584.8 filed on Dec. 22, 2010, which application is incorporated herein by reference.

FIELD OF THE INVENTION

The invention relates to a sports appliance, in particular to an appliance for swing exercises in golf sports, which is a high photoelectric sensing instant display type golf swing collimation trainer capable of reflecting the collimation of putting and the ball hitting level of a player in a real-time manner specifically.

BACKGROUND OF THE INVENTION

At present, golf sports are widely developed in China, as the golf sports have high requirements on athletes, and the swing angle is particularly in direct relation with the movement track, the distance, the falling point and other key parameters, the swing must be exercised for well playing the golf.

As known to all, a golf ball needs to be sequentially hit into 18 holes during the golf sports, the total length of the distance among the holes is more than 6000 m, a lawn region, namely a putting green, is arranged on the periphery of each hole, and a putter is used on each putting green for putting the golf ball into the hole. The putting greens are connected through fairways and the distances between every two holes vary from 230 m to 540 m, the ball can achieve the putting green by being hit by wood clubs and iron clubs for a plurality of times.

The ball hitting club head of the wood club or the iron club forms a certain include angle with a club body, the included angle is named as a club head angle, the angle can increase along with the increase of the number of the wood club or the iron club, wherein the using frequency of the medium iron clubs (No. 5-No. 7) is highest, the club head angles vary in a range of 30-39 degrees, and the angle is the included angle formed between the hitting surface of the club head and the club body. As long as the direction of the normal line of the club head is consistent with the direction line of a target when the club head takes a swing at the ball during swing, the deviation of the flight direction of the golf ball is very small and the ideal swing effect can be achieved.

Therefore, in order to well play the golf ball, the swing needs to be exercised. In general, the swing exercises need to be done by going to a golf course for exercises with the balls, thereby needing to consume a lot of time and being high in cost. Then, people invent various swing trainers and the athletes can complete the swing exercises indoors, such as the inventions in the publication numbers of CN1153055A and CN1169687A and the swing trainers developed by America, Korea and the like.

As for these swing trainers, the balls need to be used for performing practical ball hitting exercises, and equipment is further expensive in price, thereby being not suitable for indoor use. For this reason, Chinese patent ZL200720038548.0 designed a golf swing trainer which could better solve the problem of indoor swing exercises of the athletes, and was conductive to development of the golf sports and the improvement of the level of the players.

But the applicant finds that the trainer disclosed by ZL200720038548.0 can only detect the collimation degree during ball hitting due to the fan-shaped distribution of transmission sensing elements and can not detect the translation state of the club, which is the most key factor and can directly affect the ball hitting distance and the collimation in the golf sports, namely the bottom of the club still needs to keep the state during ball hitting for 5-30 cm after the club hits the ball; furthermore, the longer the kept translation distance, the better the ball hitting effect.

Simultaneously, the applicant further finds that the trainer of the patent has the problems of great debugging difficulty and higher equipment cost, so that the trainer needs to be improved.

SUMMARY OF THE INVENTION

The invention aims at designing a photoelectric sensing instant display type golf swing collimation trainer which is simple in structure and low in cost, can detect not only the collimation state of a club head when a ball is hit but also the collimation state during the follow-through process, perform the related exercises without using the ball and is suitable for indoor use of beginners and convenient for popularization against the problems that an existing golf swing exercise device can not comprehensively detect the ball hitting state of the club head and is difficult to debug and high in cost.

The technical scheme of the invention is as follows:

A photoelectric sensing instant display type golf swing collimation trainer comprises a base 1 and a display device 2, and is characterized in that two photoelectric sensor mounting supports 3, 3' are mounted on the base 1, two groups of photoelectric detection devices comprising transmitters 4 and sensors 5 are at least mounted on each mounting support 3 or 3', the distance between the two sensors 5 on each mounting support is matched with the distance of the straight line section at the bottom of a club head of a golf club, when the club head of the golf club passes between the transmitters 4 and the sensors 5, the pulse receiving of the sensors 5 is blocked, and the sensors 5 are used for sending the synchronous state of blocking the pulse receiving of the club head of the golf club to the display device 2 which is electrically connected with the sensors 5 for real-time display.

The transmitters 4 are laser transmitters and the sensors 5 are laser receivers.

The distance between the two mounting supports 3, 3' is adjustable, and the adjustable distance is 5-30 cm.

The distances between the transmitters 4 and the sensors 5 are adjustable, and the positions of the transmitters 4 and the sensors 5 are interchangeable; and the connecting lines between the transmitters 4 and the sensors 5 can be vertical lines which are vertical to the horizontal plane and can also be oblique lines.

The display device 2 is a light display device or a display screen.

A guide plate for enabling the trainer to become a putting trainer is further mounted on the base 1.

The invention has the following benefits:

The invention is simple in structure, convenient to manufacture and debug, low in cost and suitable for indoor and outdoor exercises of beginners.

The invention can not only reflect whether the club head at the instant of ball hitting is collimated or not, but also show the translation state of the club head after ball hitting and further reflect the coordinated motion state of the crotch of a player; furthermore, the translation distance can be adjusted according to the continuous improvement of the exercise level of a user, thereby being conductive to reflecting the ball hitting level on the whole. The invention is particularly suitable for the beginners to exercise without the balls, and the beginners can perform the exercises with the balls after finding the swing feeling.

The invention can not only be used as the swing exercise device, but also become the putting trainer by adding the putting guide plate, thereby realizing multiple purposes in one machine.

BRIEF DESCRIPTION OF THE DRAWINGS

FIG. 1 is a schematic diagram of three-dimensional structure of the invention.

DETAILED DESCRIPTION OF THE INVENTION

In combination of the FIGURE and the embodiment, the invention is further described as follows.

As shown in FIG. 1, a photoelectric sensing instant display type golf swing collimation trainer comprises a base 1 and a display device 2, wherein the base 1 can be embedded on a sponge or rubber type cushion pad 6 as a whole during the specific implementation, two photoelectric sensor mounting supports 3, 3' are mounted on the base 1, two groups of photoelectric detection devices comprising transmitters 4 and sensors 5 are at least mounted on each mounting support 3 or 3', the distance between the two sensors 5 on each mounting support is matched with the distance of the straight line section at the bottom of a club head of a golf club, when the club head of the golf club passes between the transmitters 4 and the sensors 5, the pulse receiving of the sensors 5 is blocked, the sensors 5 are used for sending the state of blocking a light path of the club head of the golf club to the display device 2 which is electrically connected with the sensors 5 for real-time display after processing the state, and data processing can adopt an existing conventional circuit and software for realization.

The transmitters 4 and the sensors 5 can be vertically mounted (the connecting lines between the two are vertical) or be obliquely mounted on the premise that the light of the transmitters 4 can be received by the sensors 5.

In order to improve the transmitting and receiving effects and prevent the interference, the transmitters 4 can adopt laser transmitters, the sensors 5 can correspondingly adopt laser sensors, and the transmitters 4 can be mounted on the base and flush with the movement ground of the club head, or be mounted at the upper parts of the supports, namely the mounting positions of the transmitters and the sensors are interchangeable; in the FIGURE, the transmitters 4 and the sensors 5 are vertically mounted, and then the shapes of the mounting support 3, 3' can be designed to the shapes like nixietube letter C; in FIG. 1, the laser transmitters are mounted on upper cross rods of the mounting supports 3, 3', and the sensors are mounted on lower cross rods of the mounting supports 3, 3'; in addition, in order to facilitate the continuous improvement of the swing level of an exerciser, the distance between the two mounting supports 3, 3' needs to be designed to an adjustable structure, wherein one mounting support 3 (or 3') is immobilized, the other mounting support 3' (or 3) can move in the base 1, the adjustable distance is controlled within 5-30 cm, distance scale marks 7 are arranged on the front surface of the base 1, and movement and positioning structures can adopt common structures; in FIG. 1, a guide groove is arranged on the base 1, one support 3' (or 3) can move in the guide groove, and a screw 8 for locking is arranged at the front part of the base 1.

In addition, during the specific implementation, the heights of the mounting supports 3 and 3' can also be designed to be adjustable, namely the distances between the transmitters 4 and the sensors 5 are adjustable; in FIG. 1, the straight rod parts of the C-shaped mounting supports 3 and 3' comprise two sections or more than two sections, and the sections are mutually connected by plug-in mounting or rotary mounting and positioned through locking screws. The display device 2 in the invention can adopt a light type indicator or a display screen; when the display screen is adopted, corresponding display software and a display screen support need to be increased, and the cost is higher.

In FIG. 1, the light display device is adopted and comprises a red row of indicating lamps and a green row of indicating lamps, and each row comprises four indicating lamps for respectively showing the collimation state and the oblique state of the club head. When the club head passes through the four groups of the transmission sensing detection devices in the required straight state, as the two sensors on each support have no time difference or have the time difference within an allowable range, a display control circuit does not act; if the club head is in deflection when entering into the first mounting support 3' (the support on the left side), the left two green lamps in the second row of the green lamps 10 of the display device 2 can be turned on respectively according to the difference deflection angles, if the first lamp on the left in the second row of the green lamps 10 is turned on, the forward deflection of the club head is indicated, if the second lamp is turned on, the backward deflection of the club head is indicated. If the third green lamp is turned on, the forward deflection of the club head during the outward swing of the club is indicated, if the fourth green lamp is turned on, the backward deflection of the club head during the outward swing of the club is indicated, and then a person swinging the club can very conveniently know the posture which needs to be adjusted during the inward swing of the club and the outward swing of the club by only observing the on-states of the lamps; along with the continuous improvement of the exercise level, the distance between the two mounting supports 3, 3' can be enlarged, and the translation distance of the club head of the top athlete does not exceed 30 cm generally, so that the maximum distance between the mounting supports 3, 3' can be set to be 30 cm during the specific implementation.

In addition, after the swing exercises of the exerciser achieve a certain stage, the putting exercises can also be performed; when the putting exercises are performed, only a guide plate (not shown in the FIGURE) for the putting exercises needs to be added on the base. The biggest characteristic of the invention is that the invention can be used for the exercises without the balls, thereby improving the swing level of the beginners and laying a solid foundation for performing actual ball hitting.

The non-involved parts are the same with the prior art or can be realized by adopting the prior art.

What is claimed is:

1. A golf swing trainer for monitoring movement of a club head comprising:

a base, wherein the base has a groove;

a first monitoring device for a collimation state of the club head at an instant of ball hitting including:

a first mounting support on the base, wherein a height of the first mounting support is adjustable relative to the base, first and second groups of transmitter-sensor are mounted on the first mounting support, a distance between the first and second groups of transmitter-sensor matches with a straight line section at the bottom of the club head;

a second monitoring device for translation state of the club head after ball hitting including:

a second mounting support moveably on the base, wherein a height of the second mounting support is adjustable relative to the base, third and fourth groups of transmitter-sensor are mounted on the second mounting support, a distance between the third and fourth groups of transmitter-sensor matches with a straight line section at the bottom of the club head, and wherein the distance between the first and second mounting support is 5 to 30 cm, and the second mounting support is moveable within the groove and is locked in the groove by a screw;

a display device for showing monitoring results from the first and second monitoring devices.

2. The golf swing trainer of claim 1, wherein the transmitters are laser transmitters and the sensors are laser sensors.

3. The golf swing trainer of claim 1, wherein a distance between the transmitters and sensors of each group is adjustable, and positions of the transmitters and sensors of each group are interchangeable, a connecting line between the transmitters and sensors of each group is vertical or oblique to the base.

4. The golf swing trainer of claim 1, wherein the display device is a light display device or a display screen.

* * * * *